US007104215B2

(12) United States Patent
Von Tersch

(10) Patent No.: US 7,104,215 B2
(45) Date of Patent: Sep. 12, 2006

(54) MOORING LINE RETRACTING/EXTRACTING FITTING

(76) Inventor: Ramon J. Von Tersch, 15829 N. 15th St., Phoenix, AZ (US) 86022

( * ) Notice: Subject to any disclaimer, the term of this patent is extended or adjusted under 35 U.S.C. 154(b) by 0 days.

(21) Appl. No.: 11/200,435

(22) Filed: Aug. 9, 2005

(65) Prior Publication Data

US 2006/0054069 A1 Mar. 16, 2006

Related U.S. Application Data

(60) Provisional application No. 60/601,407, filed on Aug. 12, 2004.

(51) Int. Cl.
*B63B 21/00* (2006.01)

(52) U.S. Cl. ..... 114/230.23; 114/364

(58) Field of Classification Search ..... 114/218, 114/230.2, 230.23, 230.24, 254, 364; 242/377, 242/384.7, 385.4
See application file for complete search history.

(56) References Cited

U.S. PATENT DOCUMENTS

| | | | | |
|---|---|---|---|---|
| 1,811,400 | A * | 6/1931 | McClellan | 114/218 |
| 3,851,613 | A * | 12/1974 | Armour | 114/230.23 |
| 4,697,537 | A | 10/1987 | Smith | 114/230 |
| 4,846,090 | A | 7/1989 | Palmquist | 114/230 |
| 5,002,003 | A | 3/1991 | Blue | 114/230 |
| 5,598,805 | A | 2/1997 | Obrinski | 114/230 |
| 5,870,963 | A | 2/1999 | Alan | 114/230 |
| 5,988,094 | A | 11/1999 | Obrinski | 114/230 |
| 6,041,729 | A | 3/2000 | Alan | 114/230.2 |
| 6,095,075 | A | 8/2000 | Gordon et al. | 114/230.23 |
| 6,202,585 | B1 | 3/2001 | Alan | 114/219 |

* cited by examiner

*Primary Examiner*—Lars A. Olson
(74) *Attorney, Agent, or Firm*—Cahill, von Hellens & Glazer, P.L.C.

(57) ABSTRACT

A deck mounted fitting provides for extraction and retraction of a mooring line for a vessel. A container below deck may be used to store the mooring line. Extraction of the mooring line may be manually carried out and retraction of the mooring line may be carried out manually or by a selectively actuatable electric motor or wound spring rotating a wheel in engagement with the mooring line. A collar is disposed within the fitting to maintain the mooring line available for manual extraction during mooring of the vessel.

18 Claims, 4 Drawing Sheets

MOORING LINE RETRACTING/EXTRACTING FITTING

CROSS REFERENCE TO RELATED APPLICATIONS

The present application is related to and claims priority of a provisional application entitled "MOORING LINE POCKET", filed Aug. 12, 2004, and assigned Ser. No. 60/601,407, by the present inventor.

BACKGROUND OF THE INVENTION

1. Field of the Invention

The present invention relates to mooring lines and, more particularly, to a fitting for accommodating extraction and retraction of a mooring line.

2. Description of Related Prior Art

Mooring lines for boats, and ships and other vessels are traditionally stored in bags below decks during non use. Sometimes, the mooring lines are coiled on the deck usually in proximity to the attendant cleat to which they may be attached when in use. To store the mooring line in a bag is a nuisance as the mooring line must be placed within the bag and the bag must be stored in a suitable space within the cabin, in a locker or the like. Coiled mooring lines on deck tend to slide and may be an impediment to movement on the deck. Under severe weather conditions, the coiled mooring line may become uncoiled and cause a potential safety hazard or impediment to the crew. It would therefore be beneficial to have the mooring line readily accessible when required and yet be storable proximate the cleat to which it will be attached when in use.

SUMMARY OF THE INVENTION

A hollow fitting is penetrably attached to the deck of a boat, ship or other vessel proximate the cleat at the gunwhale with which it will be used. Upon extraction, a sufficient length of mooring line is drawn to permit mooring to a dock or the like and attachment to the cleat adjacent the gunwhale. During retraction, the mooring line is fed downwardly through the fitting into an underlying bag or compartment wherein it will be stored during non use. A collar within the fitting prevents passage of the free end through the fitting such that a sufficient length protrudes to permit manual engagement upon extraction. A pair of opposed recesses may be formed in the fitting to minimize protrusion of the free end of the mooring line above the deck and yet render the free end accessible. Retraction may be enhanced by a motor driven or spring operated wheel frictionally contacting the mooring line to effect retraction. Alternatively, the mooring line may be wound about a motor or spring operated spool below deck.

It is therefore a primary objection of the present invention to provide an extraction and retraction fitting for a mooring line of a vessel.

Another object of the present invention is to provide a fitting extending through the deck of a vessel for accommodating extraction and retraction of a mooring line.

Yet another object of the present invention is to provide an electrically operated fitting for retracting a mooring line for a vessel.

Still another object of the present invention is to provide a spring operated fitting for retracting a mooring line of a vessel.

A further object of the present invention is to provide a collar disposed in the fitting to retain the free end of the mooring line manually accessible when the mooring line has been retracted.

A yet further object of the present invention is to provide a detent supported collar in a deck mounted fitting cooperating with the free end of a mooring line retractable through the fitting to a location below deck.

A still further object of the present invention is to provide a method for storing a mooring line below deck.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
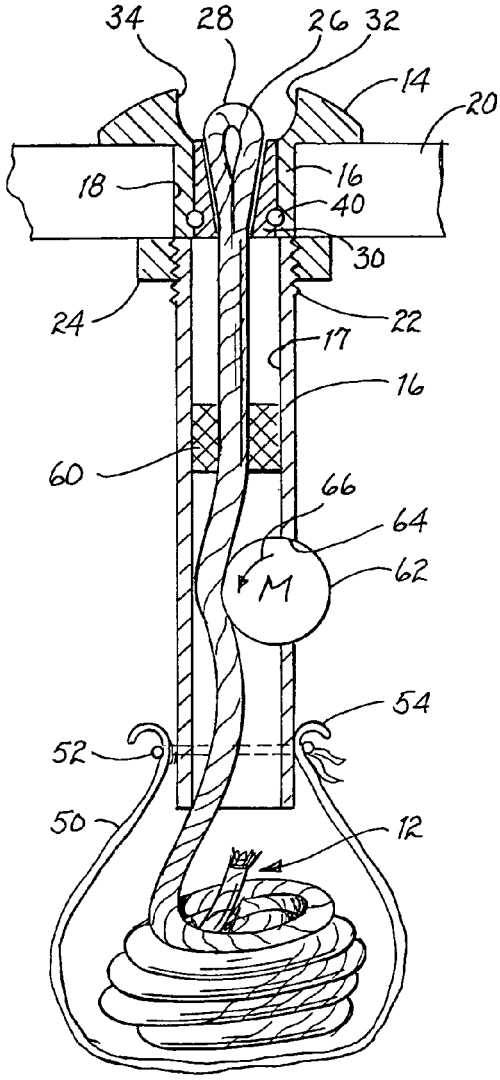
FIG. 1 illustrates a partial cross sectional view of a fitting for retracting and extending a mooring line.

Referring to FIG. 1, there is shown a partial cross sectional view of a fitting 10 to be used in a vessel for retracting, storing and extracting a mooring line 12. The fitting is formed by a top 14 having a hollow shaft 16 defining a passageway 17 extending downwardly therefrom. The shaft extends through an aperture or hole 18 in a part of a deck 20 of a vessel. The shaft includes external threads 22 for threaded engagement by a nut 24 to secure the deck between top 14 and the nut and thereby retain fitting 10 in place; a lock washer may be used to insure against loosening of the nut.

Figure 3:
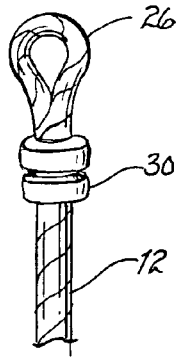
FIG. 3 illustrates the collar mounted upon the free end of the mooring line.
Figure 11:
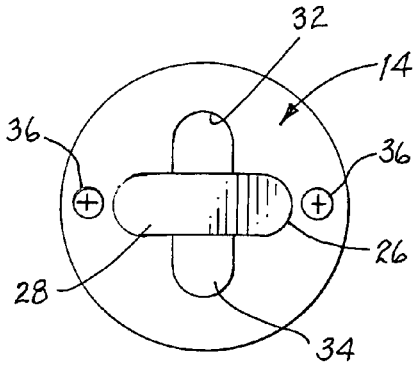
FIG. 11 is a top view of the fitting disposed on the deck of a vessel.

The main function and purpose of fitting 10 is that of accommodating extraction and retraction of mooring line 12 to render it readily accessible for mooring purposes and yet maintaining it out of the way during non use. A illustrated, the mooring line may include a loop 26 at free end 28. To prevent retraction of the free end into the fitting or into the compartment within which the mooring line is stored, a collar 30 encircles mooring line 12, as particularly illustrated in FIG. 3. The collar is slidable into shaft 16, as illustrated in FIG. 1, to a depth sufficient to permit free end 28 to be generally coincident with top 14. As particularly illustrated in FIG. 11, the top includes a pair of opposed recesses 32, 34 to permit manual grasping of free end 28 of the mooring line for purposes of extracting the mooring line. As shown in FIG. 11, the top may be further secured to the deck by screws 36.

Figure 2:
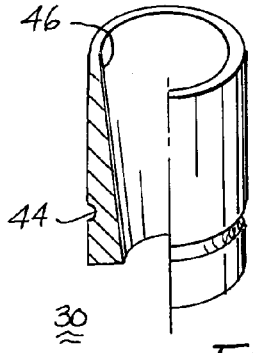
FIG. 2 is a partial cross sectional view of a collar for engaging the free end of the mooring line.
Figure 5:
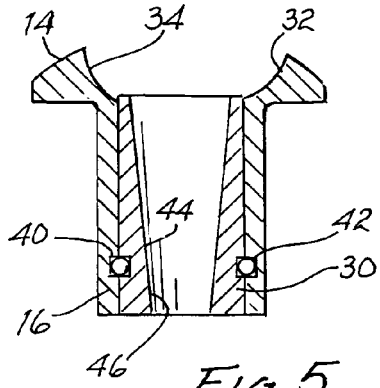
FIG. 5 is a partial cross sectional view illustrating use of a O-ring as a detent to retain the collar in place.
Figure 4:
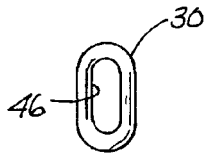
FIG. 4 illustrates an alternative oval cross section of the collar.

Collar 30 may be retained in place within shaft 16 by a plurality of mechanisms. For example, shaft 16 may include an annular groove 40 for supporting an O-ring 42. Collar 30 includes a commensurate groove 44 for capturing a radially inner part of the O-ring upon insertion of the collar into shaft 16. Thereby, the O-ring and commensurate grooves serve in the manner of a detent to prevent further retraction of the mooring line. A illustrated in FIGS. 2 and 5, interior surface 46 of the collar may be in the form of an inverted cone to urge compressive engagement of free end 28 of the mooring line and thereby prevent sliding movement of the mooring line through the collar during normal use. It is to be understood that the collar may be formed with any of several different internal dimensions to accommodate different sized mooring lines. Thereby, a single fitting 10 may be use irrespective of the size of the mooring line and yet accommodate a range of mooring line diameters. Moreover, depending upon the manner in which loop 26 is formed at free end 28 of the mooring line, that is, whether the loop is formed by a splice or whether the mooring line is simply folded back on itself, collar 30 may be oval shaped to accommodate the latter configuration, as illustrated in FIG. 4.

A bag 50 may be secured to the lower end of hollow shaft 16 as shown in FIG. 1, for containing the retracted mooring line. A drawstring 52, or the like, is disposed about opening 54 of the bag to secure the bag to the lower end of the shaft. To prevent unwanted extraction of the mooring line when the vessel is underway or otherwise, due to rough seas, inadvertent contact with free end 28, or for other reasons, a friction pad 60 may be disposed within hollow shaft 16 to frictionally contact mooring line 12. The resulting frictional contact will tend to prevent unfettered extraction of the mooring line.

It is contemplated that the mooring line will be manually withdrawn from fitting 10 to serve its function as a mooring line. When the vessel casts off, the mooring line may be manually fed into fitting 10 to store the mooring line within bag 50, as illustrated, or other container disposed at the lower end of the hollow shaft. To simplify retraction of the mooring line, a wheel 62 may extend into the shaft through an opening 64, such as a slot, into frictional engagement with the mooring line. Upon rotation of wheel 62, as depicted by arrow 66, the wheel will draw the mooring line downwardly through the hollow shaft. To enhance the frictional contact between the wheel and the mooring line, the wheel may include nubbins, spikes or cross hatching to increase the strength of the grip between the wheel and the mooring line. The wheel may be actuated by an electric motor or by a wound spring. Such a spring would unwind during retraction of the mooring line and be wound during extraction of the mooring line as a result of the frictional contact between the mooring line and the wheel which causes rotation of the wheel in the direction opposite to that depicted by arrow 66. It is feasible to have a crank attached to wheel 62 to effect manual retraction of the mooring line by turning the crank.

Figure 6:
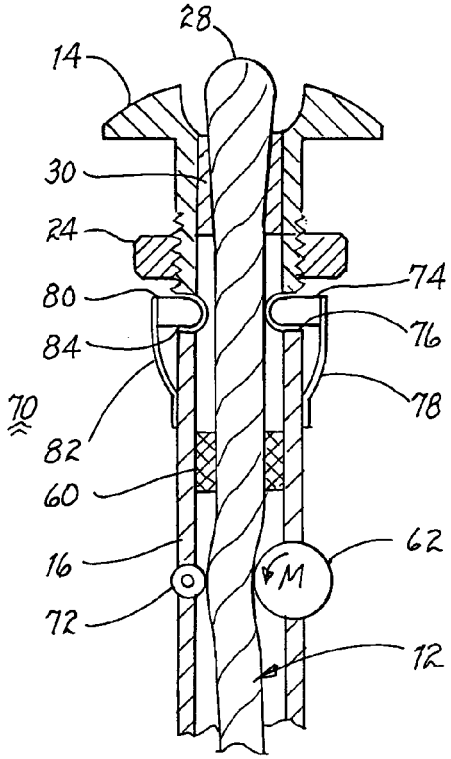
FIG. 6 illustrates a first variant of the fitting.

FIG. 6 illustrates a first variant 70 of fitting 10. This variant includes a motorized wheel 62, whether by electric motor or spring. To facilitate passage of mooring line 12, a roller 72 may be disposed on a side of shaft 16 opposite wheel 62. Instead of an O-ring to secure collar 30, a prong 74, biased through an aperture 76 in shaft 16 by a spring 78, will engage groove 44 in the collar. A second prong 80 biased by a second spring 82 penetrates through aperture 84 in shaft 16 into engagement with groove 44. The remaining elements of first variant 70 which are common to fitting 10 need not be discussed.

Figure 7:
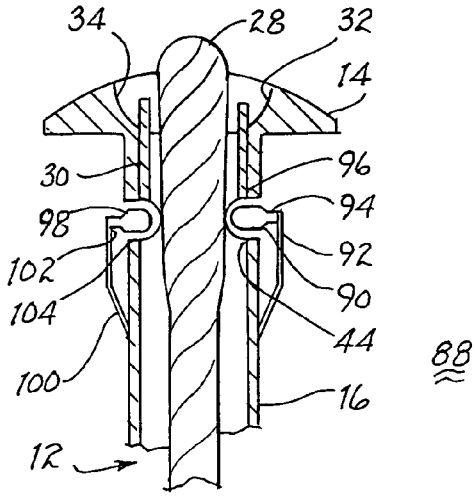
FIG. 7 illustrates a variant of the detent.

FIG. 7 illustrates a second variant 88 of fitting 10 wherein a yet further mechanism may be used to retain collar 30 in place upon retraction of mooring line 12. A first spring loaded ball 90 may be secured to a base 92 formed as part of shaft 16 through a spring 94. The ball extends through an aperture 96 in the shaft into engagement with groove 44 of the collar. A similar second spring loaded ball 98 may be disposed diametrically opposed to ball 90 and retained in place by a further base 100 supporting a spring 102. Ball 98 would also extend through an aperture 104 in shaft 16 to permit engagement of the ball with groove 44 in the collar.

Figure 8:
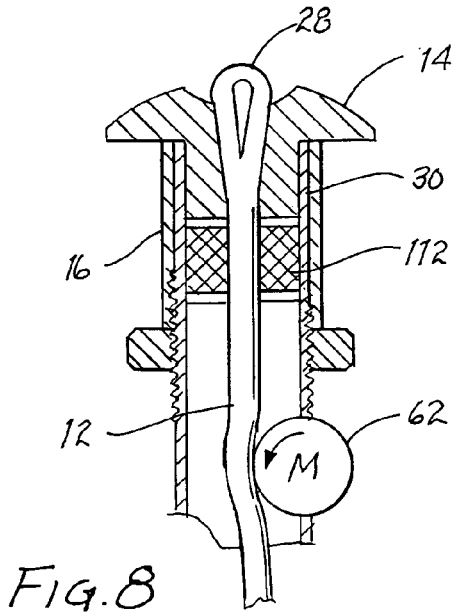
FIG. 8 illustrates a second variant of the fitting.

FIG. 8 illustrates a third variant 110 of fitting 10. Collar 30 includes an interiorly mounted friction element, such as a sleeve 112 of carpet like material having a nap oriented radially inwardly to encircle and frictionally engage mooring line 12. Thereby, a degree of friction would be present to restrain extraction of the mooring line unless overcome by manually drawing the mooring line out from second variant 110.

Figure 9:
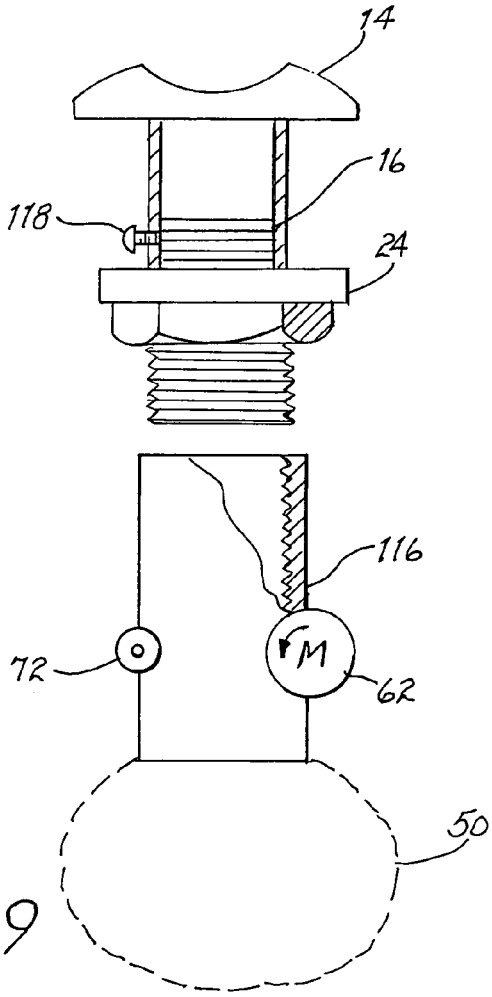
FIG. 9 illustrates a third variant of the fitting.

FIG. 9 illustrates a variation of shaft 16. Herein, the shaft extends downwardly from top 14 for a limited distance and generally somewhat greater than the thickness of the deck to be engaged. Nut 24 would be drawn up against the bottom surface of the deck. Thereafter, a sleeve 116 would be threadedly or otherwise engaged with shaft 16. To retain the sleeve in place, a set screw 118 could be used. Sleeve 116 may include wheel 62 and its related electric motor or spring. A roller 72 could be used to enhance downward movement of a mooring line within the sleeve when it is urged downwardly by rotation of wheel 62. A bag 50 may be attached to a lower end of the sleeve to store the mooring line when it has been retracted. The main purpose of using sleeve 116 is that of accommodating variations in available vertical space below the deck.

Figure 10:
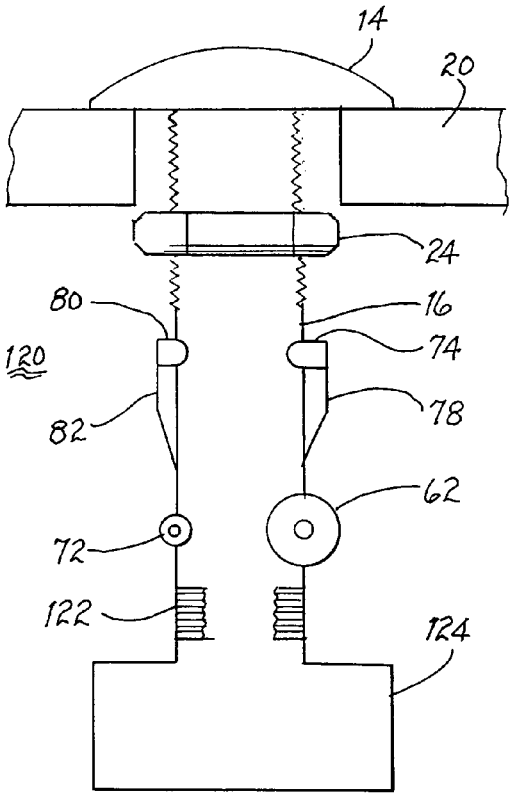
FIG. 10 illustrates a fourth variant of the fitting.

FIG. 10 illustrates a fourth 120 variant of fitting 10, which variant is similar to first variant 70, shown in FIG. 6. The main differences between fourth variant 120 and first variant 70 will be discussed below. Friction material 122, such as a ring of carpet having inwardly facing nap, may be disposed interiorly of shaft 16 to restrict unwanted extraction of the mooring line. Moreover, shaft 16 may be secured to a box or other container 124 for storing the mooring line after retraction. Depending upon the vertical space desired between deck 20 and container 124, a section of shaft 16 may be replaced by a length of a sleeve, such as sleeve 116 shown in FIG. 9.

Figure 12:
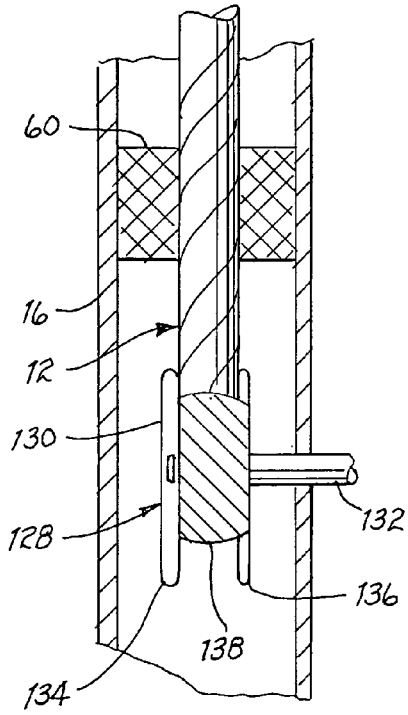
FIG. 12 illustrates a motor driven spool for effecting retraction of the mooring line.

FIG. 12 illustrates a variant 128 of wheel 62 for urging retraction of mooring line 12. In particular, wheel 62 may be replaced by a spool 130 to provide greater purchase to the mooring line as it is being drawn through the fitting. Shaft 132 extending from the spool may be actuated by an electric motor, a spring or even a hand crank. It may be noted that discs 134, 136 forming the spool may be of high friction material to assist in temporarily gripping the mooring line during rotation of the spool. Additionally, hub 138 may be of rubber or similar material to increase the frictional contact with the mooring line.

Figure 13:
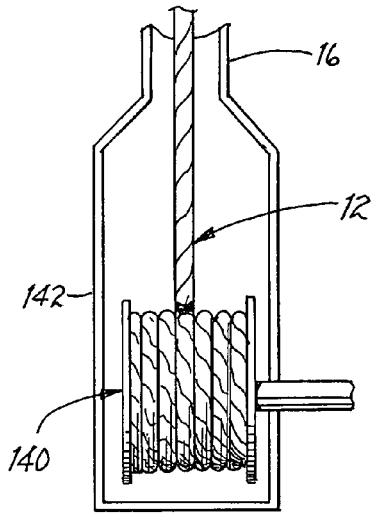
FIG. 13 illustrates a motor driven spool for storing the mooring line.

FIG. 13 illustrates a further variant of the retraction mechanism for mooring line 12. A take up spool 140 permits winding of the mooring line thereabout, as illustrated. Necessarily, such a spool must be within an enclosure or a container 142 of significantly greater cross sectional size than shaft 16 to which it may be attached. For example, the take up spool could be lodged within a container like container 124 shown in FIG. 10.

Figure 14:
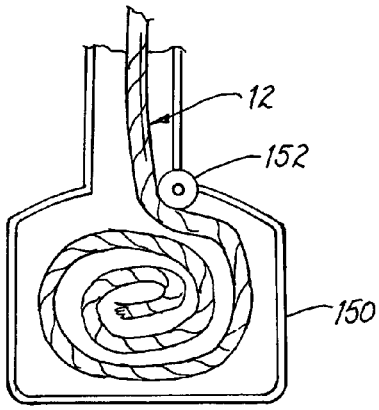
FIG. 14 illustrates a compartment as a variant of the bag shown in FIG. 1 for storing the mooring line.

FIG. 14 illustrates a container 150 for storing mooring line 12. Insertion of the mooring line into the container may be enhanced by use of a roller 152 or the like to urge spiral storing of the mooring line. Furthermore, such a roller would facilitate withdrawal of the mooring line from within the container during extraction. A similar roller could be used in other variants of the present invention to enhance passage of the mooring line through the fitting.

Figure 15:
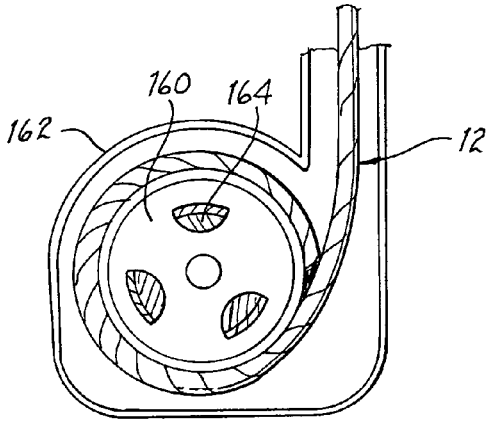
FIG. 15 is a side view of a variant of the bag for storing the mooring line.

FIG. 15 illustrates a yet further variant of a mechanism for storing mooring line 12. In particular, a spring actuated drum 160 is disposed within a container 162. During extraction of mooring line 12, spring 164 mounted internally of drum 160 would become wound. Upon retraction of the mooring line, the force exerted by spring 164 would cause the drum to rotate and mooring line 12 would become wrapped thereabout. As discussed above, the collar about the end of the mooring line would prevent the whole of the mooring line from being drawn into container 162 and the end of the mooring line would remain available at top 14 for manual extraction.

Figure 16:
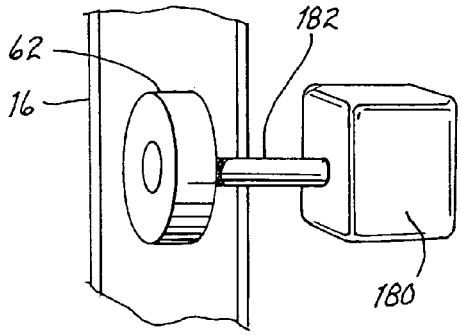
FIG. 16 illustrates a wheel or spool rotatably driven by an electric motor to effect retraction of the mooring line.

FIG. 16 primarily illustrates an enclosure or box 180 for housing an electric motor. The electric motor is connected to wheel 62 by a shaft 182. Thereby, upon actuation of electric motor, the wheel will be caused to rotate to retract the mooring line, as discussed above.

Figure 17:
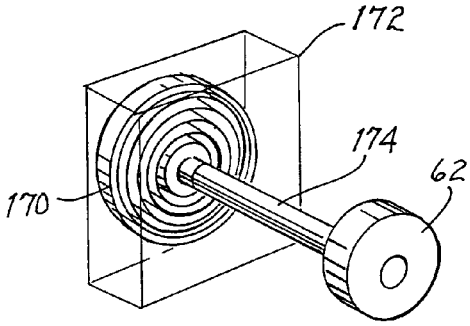
FIG. 17 illustrates a spring for providing motive means to turn a wheel or spool to effect retraction of the mooring line.

FIG. 17 illustrates a representative wheel 62 actuated by a coil spring 170 that may be mounted within a box 172 or like enclosure. The spring is connected to wheel 62 by a shaft 174. Upon release of the mooring line, the force of the spring would cause the wheel to rotate and retraction of the mooring line would occur.

I claim:

1. A ship fitting for retracting and extracting a mooring line, said fitting comprising in combination:

a) a top having a hollow shaft defining a passageway extending from about an aperture in said top, said shaft including external threads, said shaft being adapted for insertion through a hole in the deck of a ship;

b) a nut for threadedly engaging said shaft to secure said top adjacent the deck;

c) said aperture in said top and said passageway in said shaft being adapted to pass the mooring line therethrough during extraction and retraction of the mooring line;

d) a collar disposed within said shaft for preventing passage of the free end of the mooring line through said shaft; and e) a detent disposed within said shaft for disengagingly engaging said collar.

2. The apparatus as set forth in claim 1, including a container for receiving the mooring line retracted through said shaft.

3. The apparatus as set forth in claim 1, including a wheel for frictionally engaging the mooring line and an electric motor for rotating said wheel to effect retraction of the mooring line.

4. The apparatus as set forth in claim 3 wherein said wheel extends into said shaft.

5. The apparatus as set forth in claim 1, including a wheel for frictionally engaging the mooring line and a spring for rotating said wheel to effect retraction of the mooring line.

6. The apparatus as set forth in claim 5 wherein said wheel extends into said shaft.

7. The apparatus as set forth in claim 1, including friction material disposed within said shaft to create friction bearing against the mooring line during retraction and extraction of the mooring line.

8. The apparatus as set forth in claim 1, including a spool adapted to rotate in a first direction to retract the mooring line and adapted to rotate in a second direction to accommodate extraction of the mooring line.

9. The apparatus as set forth in claim 8, including an electric motor for rotating said spool.

10. The apparatus as set forth in claim 8, including a spring for rotating said spool.

11. The apparatus as set forth in claim 1, including a container in communication with said passageway within said shaft for storing the mooring line upon retraction of the mooring line.

12. The apparatus as set forth in claim 1 wherein said top includes a pair of recesses on opposed sides of the aperture to facilitate manual gripping of the free end of the mooring line when the mooring line is in the retracted state.

13. The apparatus as set forth in claim 1 wherein said detent comprises an indentation disposed in said collar and at least one spring loaded prong for engaging said indentation.

14. The apparatus as set forth in claim 1 wherein said detent comprises a groove disposed about said collar and an O-ring captured by said shaft for engaging said groove.

15. A method for retracting and extracting a mooring line stored beneath the deck of a ship, said method comprising the steps of:

a) extracting the mooring line from its stored location in a first direction through the passageway of a hollow shaft extending through the deck;

b) retracting the mooring line in a second direction through the shaft to retract the mooring line and deposit it at its stored location;

c) preventing the free end of the mooring line from passing through the shaft during said step of retraction;

d) said step of preventing being carried out by a collar disposed in the shaft; and e) retaining the collar with a detent within at least a part of the shaft.

16. The method as set forth in claim 15 wherein the shaft includes a top extending laterally from the shaft and including the step of providing manual access to the free end of the mooring line with recesses disposed within the top on opposed sides of the passageway.

17. The method as set forth in claim 15 wherein said step of retracting is carried out by electrically powered motive means.

18. The method as set forth in claim 15 wherein said step of retracting is carried out by spring motive means.

* * * * *